US008529191B2

(12) United States Patent
Oklejas, Jr.

(10) Patent No.: US 8,529,191 B2
(45) Date of Patent: Sep. 10, 2013

(54) METHOD AND APPARATUS FOR LUBRICATING A THRUST BEARING FOR A ROTATING MACHINE USING PUMPAGE

(75) Inventor: Eli Oklejas, Jr., Monroe, MI (US)

(73) Assignee: Fluid Equipment Development Company, LLC, Monroe, MI (US)

( * ) Notice: Subject to any disclaimer, the term of this patent is extended or adjusted under 35 U.S.C. 154(b) by 892 days.

(21) Appl. No.: 12/697,549

(22) Filed: Feb. 1, 2010

(65) Prior Publication Data

US 2010/0202870 A1 Aug. 12, 2010

Related U.S. Application Data

(60) Provisional application No. 61/150,342, filed on Feb. 6, 2009.

(51) Int. Cl.
*F01D 3/02* (2006.01)

(52) U.S. Cl.
USPC ..... 415/106; 415/115; 416/90 R

(58) Field of Classification Search
USPC ..... 415/115, 104, 106, 107; 416/90 R, 416/91, 93 R
See application file for complete search history.

(56) References Cited

U.S. PATENT DOCUMENTS

| | | | | |
|---|---|---|---|---|
| 659,930 | A | | 10/1900 | Kemble |
| 893,127 | A | | 7/1908 | Barber |
| 1,022,683 | A | | 4/1912 | Kienast |
| 1,024,111 | A | | 4/1912 | Anderson |
| 1,066,581 | A | | 7/1913 | Brown |
| 1,654,907 | A | * | 1/1928 | Wood ..... 415/106 |
| 2,715,367 | A | | 8/1955 | Kodet et al. |
| 2,748,714 | A | | 6/1956 | Henry |
| 3,160,108 | A | | 12/1964 | Sence |
| 3,220,349 | A | * | 11/1965 | White ..... 417/357 |
| 3,563,618 | A | | 2/1971 | Ivanov |
| 3,614,259 | A | | 10/1971 | Neff |
| 3,664,758 | A | | 5/1972 | Sato |

(Continued)

FOREIGN PATENT DOCUMENTS

| | | | |
|---|---|---|---|
| EP | 1508361 | A1 | 2/2005 |
| GB | 2363741 | A | 1/2002 |

(Continued)

OTHER PUBLICATIONS

El-Sayed E et al.: "Performance evaluation of two RO membrane configurations in a MSF/RO hybrid system". Desalination, Elsevier, Amsterdam, NL, vol. 128, No. 3, May 1, 2000, pp. 231-245, XP004204830; ISSN: 0011-9164; pp. 232-234; figure 1.

(Continued)

*Primary Examiner* — Dwayne J White
(74) *Attorney, Agent, or Firm* — Harness, Dickey & Pierce, P.L.C.

(57) ABSTRACT

A fluid machine and method of operating the same includes a pump portion having a pump impeller chamber, a pump inlet and a pump outlet and a turbine portion having a turbine impeller chamber, a turbine inlet and a turbine outlet. A shaft extends between the pump impeller chamber and the turbine impeller chamber. The shaft has a shaft passage therethrough. A turbine impeller is coupled to the impeller end of the shaft disposed within the impeller chamber. The turbine impeller has vanes at least one of which comprises a vane passage therethrough. A thrust bearing is in fluid communication with said vane passage.

29 Claims, 4 Drawing Sheets

(56) References Cited

U.S. PATENT DOCUMENTS

| | | | |
|---|---|---|---|
| 3,748,057 | A | 7/1973 | Eskeli |
| 3,828,610 | A | 8/1974 | Swearingen |
| 3,969,804 | A | 7/1976 | Macinnes et al. |
| 3,999,377 | A | 12/1976 | Oklejas et al. |
| 4,028,885 | A | 6/1977 | Ganley et al. |
| 4,029,431 | A | 6/1977 | Bachl |
| 4,187,173 | A | 2/1980 | Keefer |
| 4,230,564 | A | 10/1980 | Keefer |
| 4,243,523 | A | 1/1981 | Pelmulder |
| 4,255,081 | A | 3/1981 | Oklejas et al. |
| 4,288,326 | A | 9/1981 | Keefer |
| 4,353,874 | A | 10/1982 | Keller et al. |
| 4,432,876 | A | 2/1984 | Keefer |
| 4,434,056 | A | 2/1984 | Keefer |
| 4,472,107 | A | 9/1984 | Chang et al. |
| RE32,144 | E | 5/1986 | Keefer |
| 4,632,756 | A | 12/1986 | Coplan et al. |
| 4,702,842 | A | 10/1987 | Lapierre |
| 4,830,572 | A | 5/1989 | Oklejas, Jr. et al. |
| 4,966,708 | A | 10/1990 | Oklejas et al. |
| 4,973,408 | A | 11/1990 | Keefer |
| 4,983,305 | A | 1/1991 | Oklejas et al. |
| 4,997,357 | A | 3/1991 | Eirich et al. |
| 5,020,969 | A | 6/1991 | Mase et al. |
| 5,049,045 | A | 9/1991 | Oklejas et al. |
| 5,082,428 | A | 1/1992 | Oklejas et al. |
| 5,106,262 | A | 4/1992 | Oklejas et al. |
| 5,132,090 | A | 7/1992 | Volland |
| 5,133,639 | A | 7/1992 | Gay et al. |
| 5,154,572 | A | 10/1992 | Toyoshima et al. |
| 5,320,755 | A | 6/1994 | Hagqvist et al. |
| 5,338,151 | A | 8/1994 | Kemmner et al. |
| 5,340,286 | A | 8/1994 | Kanigowski |
| 5,482,441 | A | 1/1996 | Permar |
| 5,499,900 | A | 3/1996 | Khmara et al. |
| 5,702,229 | A | 12/1997 | Moss et al. |
| 5,819,524 | A | 10/1998 | Bosley et al. |
| 5,951,169 | A | 9/1999 | Oklejas et al. |
| 5,980,114 | A | 11/1999 | Oklejas, Jr. |
| 6,007,723 | A | 12/1999 | Ikada et al. |
| 6,017,200 | A | 1/2000 | Childs et al. |
| 6,036,435 | A | 3/2000 | Oklejas |
| 6,110,375 | A | 8/2000 | Bacchus et al. |
| 6,116,851 | A | 9/2000 | Oklejas, Jr. |
| 6,120,689 | A | 9/2000 | Tonelli et al. |
| 6,139,740 | A | 10/2000 | Oklejas |
| 6,187,200 | B1 | 2/2001 | Yamamura et al. |
| 6,190,556 | B1 | 2/2001 | Uhlinger |
| 6,309,174 | B1 | 10/2001 | Oklejas, Jr. et al. |
| 6,345,961 | B1 | 2/2002 | Oklejas, Jr. |
| 6,468,431 | B1 | 10/2002 | Oklelas, Jr. |
| 6,589,423 | B1 | 7/2003 | Chancellor |
| 6,713,028 | B1 | 3/2004 | Oklejas, Jr. |
| 6,797,173 | B1 | 9/2004 | Oklejas, Jr. |
| 6,881,336 | B2 | 4/2005 | Johnson |
| 6,932,907 | B2 | 8/2005 | Haq et al. |
| 7,077,962 | B2 | 7/2006 | Pipes |
| 7,150,830 | B1 | 12/2006 | Katsube et al. |
| 2003/0080058 | A1 | 5/2003 | Kimura et al. |
| 2004/0211729 | A1 | 10/2004 | Sunkara et al. |
| 2006/0157409 | A1 | 7/2006 | Hassan |
| 2006/0157410 | A1 | 7/2006 | Hassan |
| 2006/0226077 | A1 | 10/2006 | Stark |
| 2007/0056907 | A1 | 3/2007 | Gordon |
| 2007/0199878 | A1 | 8/2007 | Eisberg et al. |
| 2007/0289904 | A1 | 12/2007 | Okejas |
| 2007/0295650 | A1 | 12/2007 | Yoneda et al. |

FOREIGN PATENT DOCUMENTS

| | | | |
|---|---|---|---|
| WO | WO02/09855 | A1 | 2/2002 |
| WO | WO2006/106158 | A1 | 10/2006 |
| WO | WO2007/146321 | A1 | 12/2007 |

OTHER PUBLICATIONS

Geisler P. et al.: "Reduction of the energy demand for seawater RO with the pressure exchange system PES". Desalination, Elsevier, Amsterdam, NL, vol. 135, No. 1-3, Apr. 20, 2001, pp. 205-210, XP004249642; ISSN: 0011-9164; the whole document.

* cited by examiner

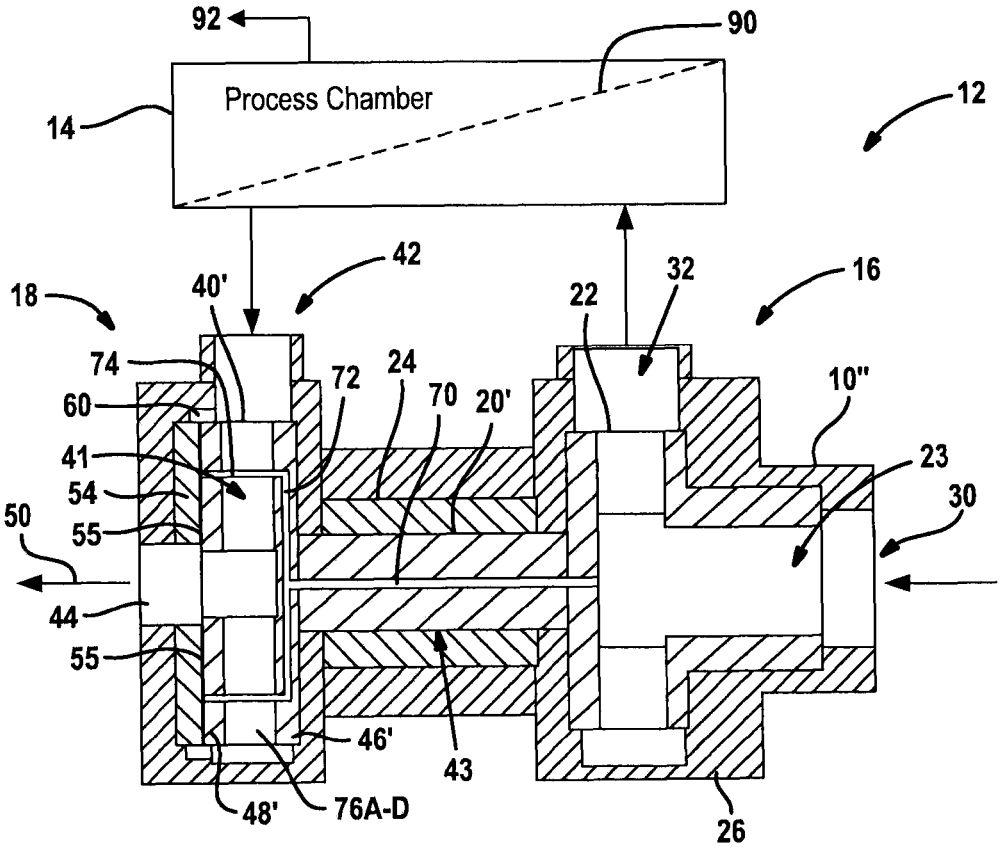
FIG. 3
FIG. 4
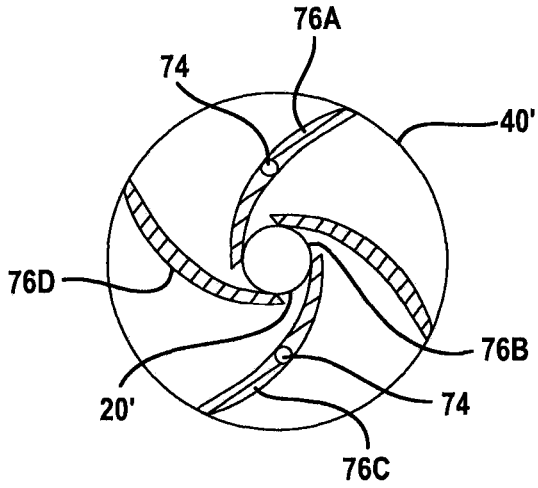

METHOD AND APPARATUS FOR LUBRICATING A THRUST BEARING FOR A ROTATING MACHINE USING PUMPAGE

CROSS-REFERENCE TO RELATED APPLICATIONS

This application claims the benefit of U.S. Provisional Application No. 61/150,342 filed on Feb. 6, 2009. The disclosure of the above application is incorporated herein by reference.

TECHNICAL FIELD

The present disclosure relates generally to pumps, and, more specifically, to thrust bearing lubrication for axial thrust force compensation within a fluid machine suitable for normal operation but useful also in start-up, shut down and upset conditions.

BACKGROUND

The statements in this section merely provide background information related to the present disclosure and may not constitute prior art.

Rotating fluid machines are used in many applications for many processes. Lubrication for a rotating fluid machine is important. Various types of fluid machines use a thrust bearing that is lubricated by the pumpage. Adequate flow of pumpage should be supplied to obtain proper lubrication. Fluid machines are used under various conditions. During normal operating conditions, lubrication may be relatively easy. However, under various transient conditions, such as start-up conditions, shut-down conditions and during upset conditions, such as passage of air through the machine, lubrication may be lost and therefore damage may occur to the fluid machine. Air entrainment or debris within the pumpage may cause upset conditions.

Referring now to FIG. 1, a hydraulic pressure booster (HPB) 10 is one type of fluid machine. The hydraulic pressure booster 10 is part of an overall processing system 12 that also includes a process chamber 14. Hydraulic pressure boosters may include a pump portion 16 and a turbine portion 18. A common shaft 20 extends between the pump portion 16 and the turbine portion 18. The HPB 10 may be free-running which means that it is solely energized by the turbine and will run at any speed where the equilibrium exists between a turbine output torque and the pump input torque. The rotor or shaft 20 may also be connected to an electric motor to provide a predetermined rotational rate.

The hydraulic pressure booster 10 is used to boost the process feed stream using energy from another process stream which is depressurized through the turbine portion 18.

The pump portion 16 includes a pump impeller 22 disposed within a pump impeller chamber 23. The pump impeller 22 is coupled to the shaft 20. The shaft 20 is supported by a bearing 24. The bearing 24 is supported within a casing 26. Both the pump portion 16 and the turbine portion 18 may share the same casing structure.

The pump portion 16 includes a pump inlet 30 for receiving pumpage and a pump outlet 32 for discharging fluid to the process chamber 14. Both of the pump inlet 30 and the pump outlet 32 are openings within the casing 26.

The turbine portion 18 may include a turbine impeller 40 disposed within a turbine impeller chamber 41. The turbine impeller 40 is rotatably coupled to the shaft 20. The pump impeller 22, the shaft 20 and the turbine impeller 40 rotate together to form a rotor 43. Fluid flow enters the turbine portion 18 through a turbine inlet 42 through the casing 26. Fluid flows out of the turbine portion 40 through a turbine outlet 44 also through the casing 26. The turbine inlet 42 receives high-pressure fluid and the outlet 44 provides fluid at a pressure reduced by the turbine impeller 40.

The impeller 40 is enclosed by an impeller shroud. The impeller shroud includes an inboard impeller shroud 46 and an outboard impeller shroud 48. During operation the pump impeller 22, the shaft 20 and the turbine impeller 44 are forced in the direction of the turbine portion 18. In FIG. 1, this is in the direction of the axial arrow 50. The impeller shroud 48 is forced in the direction of a thrust-bearing 54.

The thrust bearing 54 may be lubricated by pumpage fluid provided from the pump inlet 30 to the thrust bearing 54 through an external tube 56. A gap or layer of lubricating fluid may be disposed between the thrust bearing 54 and outboard impeller shroud which is small and is thus represented by the line 55 therebetween. A filter 58 may be provided within the tube to prevent debris from entering the thrust bearing 54. At start-up, the pressure in the pump portion 56 is greater than the thrust bearing and thus lubricating flow will be provided to the thrust bearing 54. During operation, the pressure within the turbine portion 18 will increase and thus fluid flow to the thrust bearing 54 may be reduced. The thrust bearing 54 may have inadequate lubricating flow during operation. Also, when the filter 58 becomes clogged, flow to the thrust bearing 54 may be interrupted. The thrust bearing 54 generates a force during normal operation in the opposite direction of arrow 50.

Referring now to FIG. 2, another prior art hydraulic pressure booster 10' is illustrated. The hydraulic pressure booster 10' includes many of the same components illustrated in FIG. 1 and thus the components of FIG. 2 are labeled the same and are not described further. In this example, the casing 26 has an annular clearance 60 therein adjacent to the thrust bearing 54 and the outboard turbine shroud 48. This provides a small side stream fluid flow to the thrust bearing 54 during startup. The advantage of this process is that the external tube 56 and the filter 58 are eliminated.

Challenges to rotating fluid machines and thrust bearings therein include a high inlet pressure in the pump that may result in a high axial thrust on the rotor in the direction of the turbine 18. Also, during startup pumpage may be forced through the pump portion 16 by an external feed pump upstream of the high pressure booster 10 while the turbine portion 18 runs dry or nearly dry. Flow through the pump impellers may generate a torque creating rotor rotation which may damage the thrust bearing due to the lack of lubrication. Often times, the pressure in the turbine section is much lower than the pump section and thus the lubrication may be insufficient until the full rotor speed is obtained. Process equipment between the pump discharge and the turbine inlet may occasionally introduce air into the turbine. This may occur when the process chamber or system was not purged properly during startup. Consequently, intermittent lubrication to the thrust bearing may be lost.

Further areas of applicability will become apparent from the description provided herein. It should be understood that the description and specific examples are intended for purposes of illustration only and are not intended to limit the scope of the present disclosure.

SUMMARY

This section provides a general summary of the disclosure, and is not a comprehensive disclosure of its full scope or all of its features.

The present disclosure provides an improved method for lubricating a rotating process machine during operation. The system provides pumpage to the thrust bearing over the entire operating range of the device.

In one aspect of the invention, a fluid machine comprises includes a pump portion having a pump impeller chamber, a pump inlet and a pump outlet and a turbine portion having a turbine impeller chamber, a turbine inlet and a turbine outlet. A shaft extends between the pump impeller chamber and the turbine impeller chamber. The shaft has a shaft passage therethrough. A turbine impeller is coupled to the impeller end of the shaft disposed within the impeller chamber. The turbine impeller has vanes at least one of which comprises a vane passage therethrough. A thrust bearing is in fluid communication with said vane passage.

In another aspect of the invention, a method for operating a fluid machine includes communicating fluid from the pump impeller chamber through a shaft passage to a thrust bearing at the inboard end of the bearing and generating an inboard axial force in response to communicating fluid.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

FIG. 3 is a cross-sectional view of a first fluid machine according to the present disclosure.

FIG. 4 is an end view of an impeller of FIG. 3.

DETAILED DESCRIPTION

Figure 1:
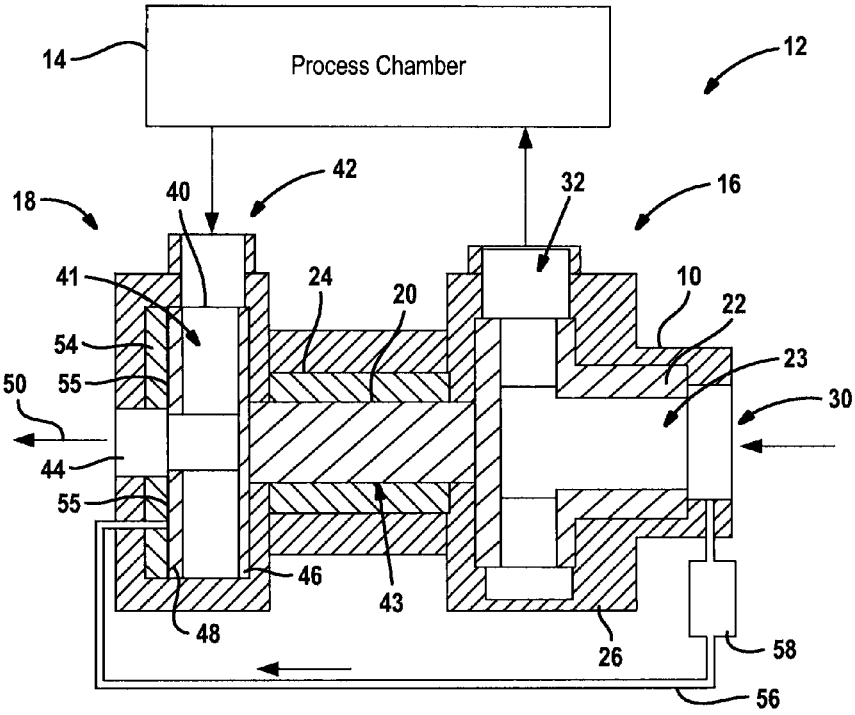
FIG. 1 Prior Art
FIG. 1 is a cross-sectional view of a first turbocharger according to the prior art.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

In the following description, a hydraulic pressure booster having a turbine portion and pump portion is illustrated. However, the present disclosure applies equally to other fluid machines. The present disclosure provides a way to deliver pumpage to a thrust bearing over the operating range of the device. The rotor is used as a means to conduct pumpage to a thrust bearing surface. A high pressure is provided to the thrust bearing from startup through the shutdown process including any variable conditions. Debris entering the turbine is also reduced.

Figure 2:
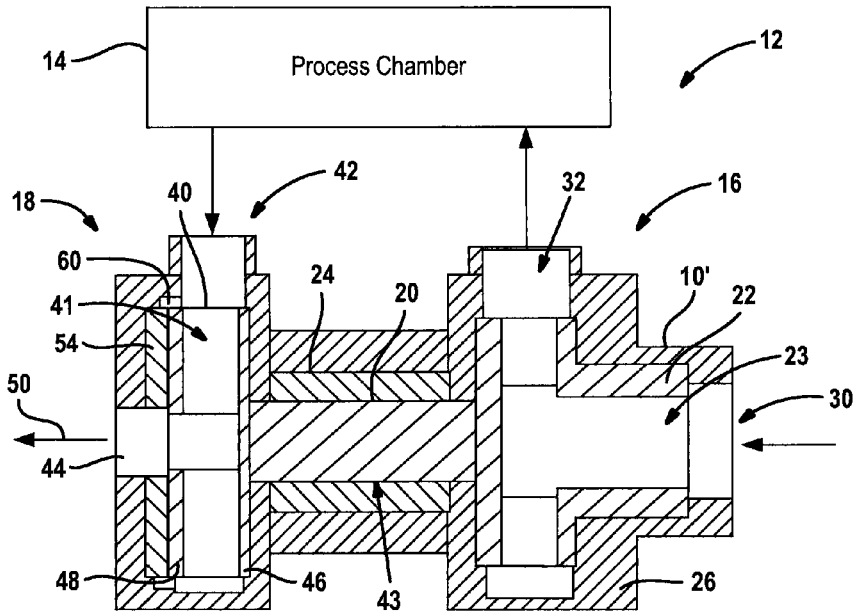
FIG. 2 Prior Art
FIG. 2 is a cross-sectional view of a second turbocharger according to the prior art.

Referring now to FIG. 3, a first embodiment of a high-pressure booster 10" is illustrated. In this example, the common components from FIG. 3 are provided with the same reference numerals are not described further. In this embodiment, a hollow shaft 20' is used rather than the solid shaft illustrated in FIGS. 1 and 2. The hollow shaft 20' has a shaft passage 70 that is used for passing pumpage from the impeller chamber 23 of the pump portion 16 to the turbine portion 18. The passage 20 may provide pumpage from the pump inlet 30.

The inboard shroud 46' includes radial passages 72. The radial passages 72 are fluidically coupled to the shaft passage 70. Although only two radial passages 72 are illustrated, multiple radial passages may be provided.

The impeller 40' may include vanes 76A-D as is illustrated in FIG. 4. The impeller 40' includes axial passages 74. The axial passages 74 may be provided through vanes 76A and 76C of the impeller 40'. The axial passages are parallel to the axis of the HPB 10" and the shaft 20'. The axial passages 74 extend partially through the inner impeller shroud 46' and entirely through the outboard impeller shroud 48'. The axial passages 74 terminate adjacent to the thrust bearing 54. Again the gap between the outboard impeller shroud 48' and the thrust bearing 54 is small and thus is represented by the line 55 in the Figure therebetween. The lubrication path for the thrust bearing 54 includes the shaft passage 70, the radial passages 72 and the axial turbine impeller passages 74.

In operation, at start-up pressure within the pump portion 16 is higher than the turbine portion 18. Fluid within the pump portion travels through the shaft passage 70 to the radial passages 72 and to the axial passage 74. When the fluid leaves the axial passage 74, the fluid is provided to the thrust bearing 54. More specifically, the fluid lubricates the space or gap 55 between the thrust bearing 54 and the outboard impeller shroud 48'. The thrust bearing 54 generates an inboard axial force in response to the lubricating fluid in the opposite direction of arrow 50.

The highest pressure in the pumpage occurs in the pump inlet 30 during startup. Passages downstream of the pump inlet are at lower pressure and thus fluid from the pump portion 16 flows to the turbine portion 18. Consequently, pumpage from the inlet is high during the startup. During shutdown of the equipment, the same factors apply due to the differential and pressure between the pump and the turbine. During normal operation, the highest pressure is no longer in the pump inlet but is at the pump outlet 32. Due to the arrangement of the lubrication passages, the pressure increases in the pumpage due to a pressure rise occurring in the radial passage 72 due to a centrifugal force generated by the rotation of the turbine impeller 40'. The amount of pressure generation is determined by the radial length of the radial passages 72 and the rate of the rotor rotation. Consequently, pumpage is provided to the thrust bearing at the startup, normal operation and shutdown of the fluid machine 10".

Referring now to FIG. 4, the impeller 40' is illustrated having four impeller vanes 76A-76D. Various numbers of vanes may be provided. The vanes extend axially relative to the axis of the shaft 20'. More than one impeller vane may have an axial passage 74. The axial passage 74 extends through the vanes 76 and the inboard impeller shroud 46' sufficient to intercept radial passage 72 and the outboard impeller shroud 48' which are illustrated in FIG. 3.

It should be noted that the process chamber 14 is suitable for various types of processes including a reverse osmosis system. For a reverse osmosis system, the process chamber may have a membrane 90 disposed therein. A permeate output 92 may be provided within the process chamber for desalinized fluid to flow therefrom. Brine fluid may enter the turbine inlet 42. Of course, as mentioned above, various types of process chambers may be provided for different types of processes including natural gas processing and the like.

Figure 5:
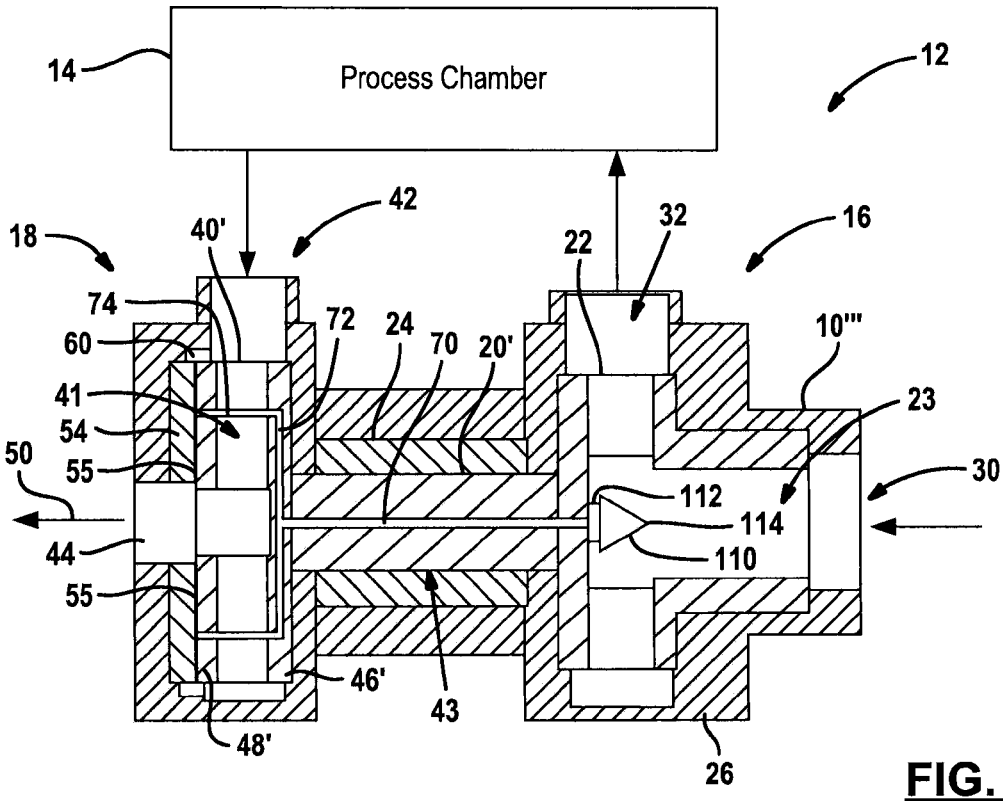
FIG. 5 is a cross-sectional view of a second fluid machine according to the present disclosure.

Referring now to FIG. 5, an embodiment similar to that of FIG. 3 is illustrated and is thus provided the same reference numerals. In this embodiment, a deflector 110 is provided within the pump inlet 30. The deflector 110 may be coupled to the pump impeller 22 using struts 112. The struts 112 may hold the deflector 110 away from the pump impeller so that a gap is formed therebetween that allows fluid to flow into the shaft passage 70.

The deflector 110 may be cone-shaped and have an apex 114 disposed along the axis of the shaft 20'. The cone shape of the deflector 110 will deflect debris in the pumpage into the pump impeller 22 and thus prevent passage of debris into the shaft passage 70. Unlike the filter 58 illustrated in FIG. 1, the debris is deflected away from the shaft passage 70 and thus will not clog the shaft passage 70.

Figure 6:
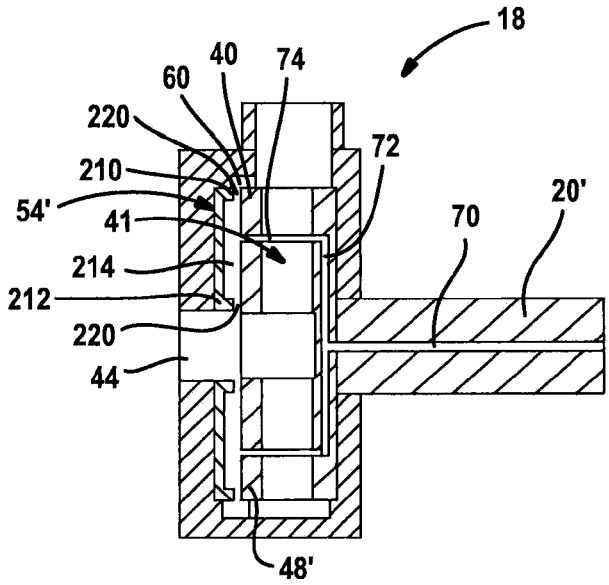
FIG. 6 is a cross-sectional view of a third embodiment of a turbine portion according to the present disclosure.

Referring now to FIG. 6, the turbine portion 18 is illustrated having another embodiment of a thrust bearing 54'. The thrust bearing 54' may include an outer land 210 and an inner land 212. A fluid cavity 214 is disposed between the outer land 210, the inner land 212 and the outer shroud 48'. It should be noted that the thrust-bearing 54' of FIG. 6 may be included in the embodiments illustrated in FIGS. 3 and 5.

The outer land 210 is disposed adjacent to the annular clearance 60. The inner land 212 is disposed adjacent to the turbine outlet 44. The thrust bearing 54' may be annular in shape and thus the outer land 210 and inner land 212 may also be annular in shape.

The cavity 214 may receive pressurized fluid from the pump portion 16 illustrated in FIGS. 3 and 5. That is, pumpage may be received through the shaft passage 70, the radial passages 72 and the axial passages 74.

Slight axial movements of the shaft 20 in the attached impeller shroud 48' may cause variations in the axial clearance 220 between the lands 210 and 212 relative to the outer shroud 48'. If the axial clearances 220 increase, the pressure in the fluid cavity 214 decreases due to an increase of leakage through the clearances 220. Conversely, if the axial gap of the clearance 220 decreases, the pressure will rise in the fluid cavity 214. The pressure variation counteracts the variable axial thrust generated during operation and ensures that the lands 210 and 212 do not come into contact with the impeller shroud 48'.

The reduction in pressure is determined by the flow resistance in the passages 70-74. The passages are sized to provide a relationship between the rate of leakage and the change in pressure in the fluid cavity 214 as a function of the axial clearance. The radial location of the channel 74 determines the amount of centrifugally generated pressure rise and is considered in ensuring an optimal leakage in addition to the diameters of the flow channel. Excessive leakage flow may impair the efficiency and insufficient fluid flow will allow clearances to be too small and allow frictional contact during operation.

The pressure in the fluid cavity is higher than the turbine outlet 44 and the pressure in the outer diameter of the impeller in the annular clearance 60 when the channel 74 is at the optimal radial location. Leakage will thus be out of cavity 214 to allow a desired pressure variation within the fluid cavity 214.

Figure 7:
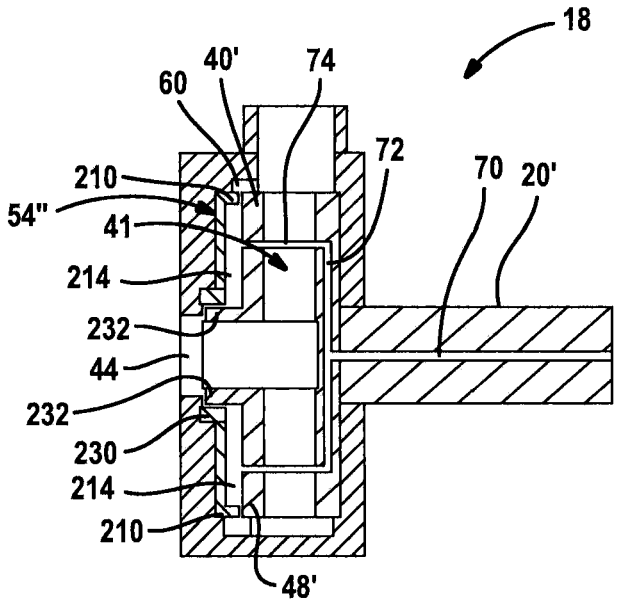
FIG. 7 is a cross-sectional view of a fourth embodiment of a turbine portion according to the present disclosure.

Referring now to FIG. 7, an embodiment similar to that of FIG. 6 is illustrated. The inner land 212 is replaced by a bushing 230. The bushing 230 may form a cylindrical clearance relative to the impeller wear ring 232. The fluid cavity 214 is thus defined between the wear ring 232, the bushing 230 and the outer land 210.

Figure 8:
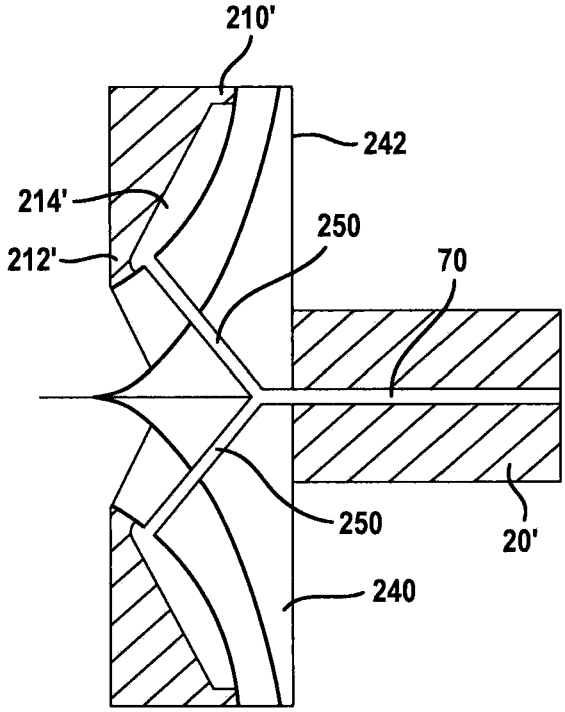
FIG. 8 is a cross-sectional view of an alternative embodiment of an impeller of the present disclosure.

Referring now to FIG. 8, vane 240 of an impeller 242 having curvature in the axial plane as well as the radial plane is illustrated. The impeller 242 may be used in a mixed flow design. In this embodiment, the outer land 210' and inner land 212' are formed according to the shape of the impeller 242. The fluid cavity 214' may also be irregular in shape between the outer land 210' and the inner land 212'.

The fluid passage 250 provides fluid directly to the fluid cavity 214' in a direction at an angle to the longitudinal axis of the fluid machine and shaft 20'. Thus, the radial passages 72 and axial passages 74 are replaced with the diagonal passage 250. The diagonal passage 250 may enter the fluid cavity 214' at various locations including near the land 212' or at another location such as near land 210'. Various places between panel 210' and 212' may also receive the diagonal passage 250.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A fluid machine comprising:

a pump portion having a pump impeller chamber, a pump inlet and a pump outlet;

a turbine portion having a turbine impeller chamber, a turbine inlet and a turbine outlet;

a shaft extending between the pump impeller chamber and the turbine impeller chamber, said shaft having a shaft passage therethrough;

a turbine impeller coupled to the impeller end of the shaft disposed within the impeller chamber, said turbine impeller having vanes at least one of which comprises a vane passage therethrough; and a thrust bearing in fluid communication with said vane passage.

2. A fluid machine as recited in claim 1 further comprising a turbine impeller shroud having a turbine impeller passage therethrough that fluidically couples the shaft passage to the vane passage.

3. A fluid machine as recited in claim 1 wherein the vane passage is an axial passage parallel to the shaft.

4. A fluid machine as recited in claim 1 wherein the same passage is disposed at an angle from the shaft passage to the thrust bearing.

5. A fluid machine as recited in claim 1 wherein the pump inlet is coaxial with the shaft.

6. A fluid machine as recited in claim 5 further comprising a cone deflector disposed adjacent to a pump end of the shaft passage.

7. A fluid machine as recited in claim 5 further comprising a deflector disposed adjacent to a pump end of the shaft passage.

8. A fluid machine as recited in claim 7 wherein the deflector is cone shaped.

9. A fluid machine as recited in claim 7 wherein the deflector is disposed coaxially with the shaft.

10. A fluid machine as recited in claim 7 wherein the deflector is coupled to the pump impeller with a strut.

11. A fluid machine as recited in claim 9 wherein the deflector is coupled to the pump impeller so that a gap between the pump impeller and the deflector fluidically coupled the pump impeller and the shaft passage.

12. A fluid machine as recited in claim 1 wherein the pump portion and the turbine portion are disposed within a casing, said casing comprising an annular clearance in fluid communication with the turbine impeller portion.

13. A fluid machine as recited in claim 1 wherein the thrust bearing comprises an outer land and an inner land that define a fluid cavity, said fluid cavity fluidically coupled to the vane passage.

14. A fluid machine as recited in claim 1 wherein the thrust bearing comprises an outer band, a bushing and a wear ring that define a fluid cavity therebetween, said fluid cavity fluidically coupled to the vane passage.

15. A fluid machine as recited in claim 14 wherein the wear ring is coupled to the shaft.

16. A processing system comprising the fluid machine recited in claim 1.

17. A processing system as recited in claim 16 wherein the fluid machine comprises a reverse osmosis pumping system.

18. A processing system as recited in claim 17 further comprising a process chamber coupled between the pump outlet and the turbine inlet.

19. A method of operating a fluid machine comprising:

communicating fluid from the pump impeller chamber through a shaft passage to a thrust bearing at a turbine end of a rotor; and generating an inboard axial force in response to communicating fluid.

20. A method as recited in claim 19 wherein communicating fluid comprises communicating fluid from the shaft passage through a vane passage in a turbine impeller to the thrust bearing.

21. A method as recited in claim 19 wherein communicating fluid comprises communicating fluid from the shaft passage through a radial impeller passage to a vane passage to the thrust bearing.

22. A method as recited in claim 19 wherein communicating fluid comprises communicating fluid from the shaft passage through a radial impeller passage to an axial vane passage to the thrust bearing.

23. A method as recited in claim 19 wherein communicating fluid comprises an impeller passage disposed at an angle relative to the shaft.

24. A method as recited in claim 19 further comprising communicating pumpage into the pump impeller chamber having debris therein and deflecting the debris from the shaft passage using a deflector.

25. A method as recited in claim 19 further comprising communicating pumpage into the pump impeller chamber having debris therein and deflecting the debris from the shaft passage using a cone-deflector.

26. A method as recited in claim 19 wherein communicating fluid comprises communicating fluid to the thrust bearing having a cavity defined by an inner land and an outer land.

27. A method as recited in claim 19 wherein communicating fluid comprises communicating fluid to the thrust bearing having a cavity defined by an outer land, a wear ring and a bushing.

28. A method of performing a process comprising:

communicating fluid from the chamber to a process chamber;

operating the fluid machine comprising the method of claim 19.

29. A method as recited in claim 27 further comprising:

generating brine fluid through a membrane in the process chamber.

* * * * *